US011382411B2

(12) United States Patent
Behnamian et al.

(10) Patent No.: US 11,382,411 B2
(45) Date of Patent: Jul. 12, 2022

(54) WATER SQUIRTING BRUSH

(71) Applicants: Giavana Behnamian, Washington, DC (US); Shahriar Behnamian, Washington, DC (US)

(72) Inventors: Giavana Behnamian, Washington, DC (US); Shahriar Behnamian, Washington, DC (US)

( * ) Notice: Subject to any disclaimer, the term of this patent is extended or adjusted under 35 U.S.C. 154(b) by 0 days.

(21) Appl. No.: 17/446,366

(22) Filed: Aug. 30, 2021

(65) Prior Publication Data

US 2022/0061517 A1 Mar. 3, 2022

Related U.S. Application Data

(60) Provisional application No. 63/260,686, filed on Aug. 28, 2021, provisional application No. 62/706,631, filed on Aug. 28, 2020.

(51) Int. Cl.
*A46B 11/00* (2006.01)
*A46B 9/02* (2006.01)

(52) U.S. Cl.
CPC ..... *A46B 11/0075* (2013.01); *A46B 9/023* (2013.01); *A46B 9/025* (2013.01); *A46B 11/001* (2013.01); *A46B 2200/104* (2013.01)

(58) Field of Classification Search
CPC ..... A46B 11/00; A46B 11/075; A46B 11/002; A46B 11/0041; A46B 11/0062; A46B 9/023; A46B 9/025
See application file for complete search history.

(56) References Cited

U.S. PATENT DOCUMENTS

| | | | | |
|---|---|---|---|---|
| 5,443,321 | A | 8/1995 | Dolan et al. | |
| 6,065,891 | A | 5/2000 | Rehman et al. | |
| 6,071,029 | A | 6/2000 | Weinstock | |
| 6,224,283 | B1 * | 5/2001 | Hay | A46B 11/0013 222/213 |
| 2004/0035435 | A1 | 2/2004 | Glucksman et al. | |
| 2005/0133055 | A1 | 6/2005 | Stankovic et al. | |
| 2019/0045913 | A1 * | 2/2019 | Langenegger | A46B 9/028 |

FOREIGN PATENT DOCUMENTS

TW M415619 U * 11/2011

OTHER PUBLICATIONS

United States Patent and Trademark Office (ISA), International Search Report and Written Opinion of the International Searching Authority for PCT Application No. PCT/US21/71306, dated Jan. 31, 2022.

* cited by examiner

*Primary Examiner* — Shay Karls

(57) ABSTRACT

A multi-functional hand-held apparatus comprising a housing and a brush to be used jointly for bathing a person, wherein the housing comprising a chamber or a container capable of holding and squirting water or a fluid through tubes or one or more pores toward a person's hair with a directional orientation toward a back of a person's head and away from a person's face. The multi-functional hand-held apparatus comprising a series of combs or the one or more bristles for rinsing hair and pulling water or the fluid and shampoo or bubbles through the person's hair. Further provided are methods for squirting fluid, such as water, with a directional orientation onto a person's head and removing soap, foam, bubbles or excess water with a brush including one or more bristles that may be curved to conform with a person's head.

20 Claims, 6 Drawing Sheets

WATER SQUIRTING BRUSH

CROSS REFERENCE TO RELATED APPLICATIONS

This application claims priority under 35 U.S.C. § 119(e) to U.S. Provisional Application 62/706,631, filed on Aug. 28, 2020. The disclosure of this prior application is considered part of the disclosure of this application and is hereby incorporated by reference in its entirety.

FIELD

The present disclosure relates generally to brushes, cups and devices made for combing and rinsing hair of humans and animals. In particular, presently disclosed subject matter relates to a cup with a brush and a method for washing or rinsing hair by dispensing water from the cup with the brush in a direction away from a face.

BACKGROUND

Various products merely allow for shampoo to be placed on a brush in order for the brush to facilitate the scrubbing of the scalp, hoses that allow for water to be transported to objects in need of rinsing, and various other products like brushes or combs that can be used wet or dry, in the shower or out of the shower.

Cups for rinsing shampooed, conditioned or washed hair that are readily available on the market provide simple measures to transfer water onto the hair. Brushes and devices that are made for combing hair of humans and animals are plain, cumbersome and not efficient in rinsing or removing soap or foam off of hair without minimizing water or soap escaping towards a predetermined direction or onto a surface that's desired to be kept as dry as possible. Rinsing cups in general comprise a cavity for holding water and may have a semi-flat edge for releasing water along a line or curve with a density or speed that's proportionate to the amount of water, liquid or fluid within the cavity of the rinsing cup and an angle of the rinsing cup at which the rinsing cup is positioned at for releasing the water or fluid.

Rinsing cups known in the art or currently available on the market may require cooperation of a first person whose hair is to be rinsed. This may present difficulties if the person is a child or a baby, who may not cooperate with a second person who is to rinse the child's hair. Therefore, traditional rinsing cups may leave the first person, whose hair is being rinsed, unhappy due to the water or foam escaping onto the first person's face or eyes.

Caregivers can currently use a hose attachment to deliver water to a baby's hair, but that hose attachment does not alone extract the water from the hair once the hair is wet. Caregivers may also use a brush in the shower, but that brush does not deliver a sufficient amount of water in an efficient manner to the hair in order to rinse the hair.

Furthermore, a specialized glove exists that allows water to flow in between teeth of combs for the purpose of rinsing a horse's coat. But the specialized glove does not control the flow of water into squirts but rather delivers a steady flow of water through the glove. The glove merely delivers the water straight out of the squirts and thereby does not help maintaining a certain surface, such as a face, clear of water or minimally disturbed by water. Hence, the problem of water or soap getting into a baby's eyes while washing or rinsing the baby's hair had not been properly met with a feasible solution.

SUMMARY

The present disclosure teaches subject matter including a multi-functional hand-held apparatus comprising a container or chamber with a semi-enclosed cavity for storing a fluid, wherein a brush being attached to the container for combing hair and guiding the fluid along the hair in a direction away from a face after the fluid being squeezed or pushed out of the cavity through pores with a curvature or slant.

The present disclosure teaches, among others, for water to be infused into hair in a directed, pressurized manner and for water to be combed through with a brush, comb, or bristles and water with a predetermined amount of force to enable rinsing of the hair. The present disclosure provides a method that prevents water and shampoo, foam, or any other washing product from getting in or onto a desired surface, for example, a baby's eyes. The apparatus may be portable and without requiring a hose attachment or may include a hose receptor for a more expedited rinsing process.

The subject matter of the present disclosure comprises a flexible and squeezable container or chamber that may be filled with an element, such as a fluid or water. The container can be clicked to open, slide to open, twisted to open, clicked to close, slide to close, or twisted to close. The container may hold enough water for one or multiple rinses. Once the user has filled the container with water through an aperture or opening, the user closes the top container or the container may automatically close. The container seals the aperture so that the only way for water to exit the container when squeezed is to squirt out of the tubes or pores at the bottom of the apparatus or along a surface, such as a brush surface, comprising a series of bristles or combs.

A user squeezing the container or a housing of the apparatus creates a pressure within the housing or chamber of the apparatus and thereby causes water to squirt out of the tubes or the pores. The tubes or pores may be angled so that the water squirts toward a back of a baby's head and away from the baby's eyes. The tubes create a pressurized stream of water that brings water to the scalp and dilutes or rinses the shampoo in the hair.

The tubes may be caused to squirt water between the hair and combs at the bottom of the apparatus or the brush surface. The combs or bristles may be aligned in rows and/or columns. The teeth of the combs may be close together at their loose ends. There may be spaces in between the teeth of the combs in which the tubes hang or are extruded beyond the brush surface in order for the stream of water to fully rinse the hair.

While or after the water has squirted from the tubes, the user may move the brush toward the back of the head. The combs may be rigid enough to pull the water and shampoo along with the apparatus, leaving the hair almost completely free of foam or shampoo. The one or more bristles or a set of combs may be flexible and soft to allow for comfort of sensitive individuals or animals, such as newborn children. he process of movements may be repeated for complete rinsing.

DESCRIPTION OF THE DRAWINGS

The drawings described herein are merely for illustrative purposes of select embodiments and not for all possible or probable implementations, and they are in no way intended to limit the scope of the present disclosure.

Corresponding reference numerals indicating corresponding parts in the multiple views of the drawings.

DETAILED DESCRIPTION

Figure 1:
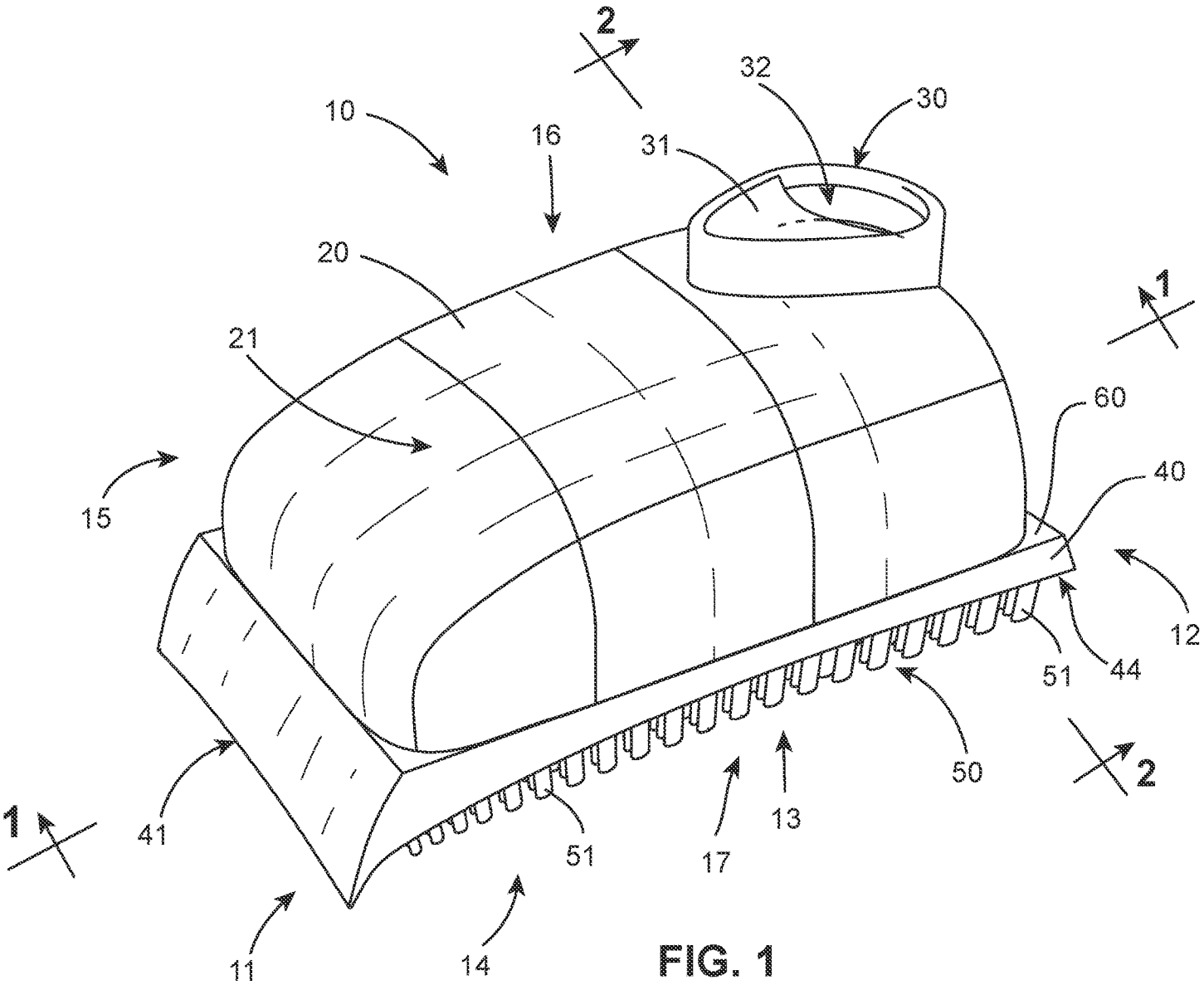
FIG. 1 is a perspective view of an exemplary apparatus in accordance with the principles of the present disclosure.

The exemplary embodiments that are going to be described within the detailed description are provided for the purpose of a thorough conveyance of the scope of the disclosure to ordinarily skilled individuals in the art. Various specific details regarding the various embodiments in view of specific methods, components and devices are provided for thoroughly and fully enable an ordinarily skilled person in the art with understanding of the present disclosure. The present disclosure entails specific details that do not need to be employed or applied, and that the exemplary embodiments of the present disclosure may take form in various other embodiments that are different from the disclosed embodiments, where the disclosed embodiments may merely be exemplary and are not to limit the scope of the enabling disclosure in any possible way. The ordinarily skilled person in the art will be enabled by the present disclosure to fully and thoroughly understand the exemplary embodiments and their enabled scope without the present disclosure's need to describe details regarding well-known methods, well-known processes, well-known structures and well-known technologies.

For the purpose of describing certain exemplary embodiments, the present disclosure employs select terminology which is not intended to be limiting but merely descriptive and inclusive of other terminology that may have not been used, unless specifically stated to exclude certain terminology. The singular forms "a," "an," and "the" may actually be intended to include the plural forms as well, unless explicitly stated not to do so. Inclusive terms "comprising," "comprises," "including," and "having," specify the presence of functional steps, features, elements, numbers, integers, steps, processes, operations, components and/or a combination thereof, but do not necessarily exclude the presence or addition of one or more other functional steps, features, elements, numbers, integers, steps, processes, operations, components and/or a combination thereof. The method steps, processes and operations explained and presented in the present disclosure are not to be understood to necessarily require their execution or performance in the particular order as disclosed or shown in the present disclosure or drawings, unless specifically disclosed or illustrated to be performed in a certain order to achieve an effective result. In any figure, any element disclosed or illustrated in a drawing is not meant to be necessarily drawn to scale or possess relative proportionality to other elements of the drawing and is merely presented to convey a general understanding of the various embodiments of the disclosure. An ordinarily skilled person is enabled by the present disclosure to understand that additional or alternative functional steps may be used or implemented to arrive at the method steps, processes, and operations.

In a case where a component, element or layer is referred to as being "on," "engaged to," "connected to," "coupled to" or "disposed in" another component, element or layer, it is understood that it may be directly on, engaged to, connected to, coupled to or disposed in the other component, element or layer, or intervening one or more components, elements or layers. On the other hand, when a component, element or layer is referred to as being "directly on," "directly engaged to," "directly connected to," "directly couple to" or "directly disposed within" another component, element or layer, there may be no intervening components, elements or layers present. Similar words may be used to describe a relationship between items, components, elements and/or layers should be interpreted in a similar fashion, e.g. "between" as compared to "directly between," "adjacent" as compared to "directly adjacent," and etcetera. Whenever presented herein, the term "and/or" includes at least one or more of all possible combinations of the one or more associated presented items.

Even though the terms first, second, third, fourth and/or etc. may be used throughout the disclosure to describe various components, elements, layers, regions, areas, sections and/or subsections, these components, elements, layers, regions, areas, sections and/or subsections are not to be limited by these terms, unless specifically disclosed otherwise. These aforementioned terms may merely be utilized to differentiate and distinguish one component, element, layer, region, area, section or subsection from another component, element, layer, region, area, section or subsection. Numerical terms "first," "second," "third," etc. and other indications of numbering terms "a)," "b)," "c)" and etc. when used herein are not indicative of a sequence or order, unless specifically indicated and described by the context. Dependent of the context to which it relates, a first component, element, layer, region, area, section or subsection as will be presented within the present disclosure could be termed a second component, element, layer, region, area, section or subsection without departing from the present disclosure's enablement. These numerical terms "first," "second," "third" and etc. are relative to the embodiment or paragraph in which they are presented and may not necessarily carry the same assignment of numerical terms in another embodiment or paragraph without departing from the disclosure of the exemplary embodiments.

Terms that may be relative in space, such as "inner," "outer," "beneath," "above," "under," "lower," "upper," "within," "inside," "between," "adjacent," "close to," "near," "proximate," "around" and other spatially relative terms are used within the present disclosure for ease of description and conveyance of the disclosure to describe a relationship between one or more elements or features with another set of one or more elements or features of the exemplary embodiments, which may also refer to the presented illustrations of the figures. Spatially relative terms may be intended to further encompass different orientations of a device being utilized or an operation in addition to the orientation of the device being utilized or the operation as shown in the figures. As an example, if the device being utilized is turned upside down, then the elements described "below," "beneath," "under" or etc. other elements or features then those elements or features would then be located "above," "over" or etc. the other elements or features of the device being utilized. Within reasonable interpretation, the example term "under" may also be depicted as "under" or "over" depending on a point of view, and thus may encompass one or more orientations. Other orientations would accordingly prompt for other spatially relative terms accordingly and descriptive of the orientation of the elements and features of the device being utilized. Furthermore, features or functional steps being described with spatially relative terms such as "under," "over" or etc., a particular "device," "area," or etc., merely describes those features or functional steps to be disposed at least partially under, over, or etc., the particular device, area or etc., unless explicitly disclosed otherwise.

The present disclosure provides for a novel approach to rinsing hair of babies, children, seniors, individuals with disabilities, people, and animals in general. Furthermore, the present disclosure may also be used on children and adults with special needs, for the elderly, in salons, and for pets.

With reference to the figures, a multi-functional hand-held apparatus for rinsing a surface with an element is provided. The terms "multi-functional hand-held apparatus" and "apparatus" may be used interchangeably throughout the specification and have the same meaning. The apparatus includes a housing holding the element within at least one or more walls. The one or more walls comprise at least a first side wall, a second side wall, and an intermediate wall. The intermediate wall may be separate from the housing. In the present disclosure, for conveyance of the present subject matter, the intermediate wall is generally disclosed to be part of the housing. One or more resealable apertures are provided. The intermediate wall of the one or more walls of the housing may comprise one or more pores, wherein the one or more pores enable the element to traverse through the intermediate wall. A first set of the one or more pores having a first directional orientation is provided. The one or more pores exert the element when engaging a first body-component or one or more of the one or more walls, wherein the first body-component attaching to the housing and moving in conjunction or independent of the housing. The one or more resealable apertures may be attached to one or more of the one or more walls or in between one or more of the one or more walls. The housing includes a chamber, wherein the chamber is created at least by the one or more walls, including the intermediate wall, and the one or more resealable apertures. Engaging the first body-component or one or more of the one or more walls creates a predetermined pressure by the element within the chamber. The predetermined pressure moves the one or more resealable apertures into a first closed position or maintains the one or more resealable apertures in the first closed position. Any one closed position may be a substantially closed position, wherein the element may escape through the closed position in a minimal amount without substantially changing the functionality of the presently disclosed subject matter. The predetermined pressure on the chamber causes a change in a volume of the chamber and creates a reduction in the volume of the chamber. Creating the predetermined pressure on the chamber and the reduction in the volume of the chamber causes the element to be exerted through at least one or more of the one or more pores. One or more bristles are provided, wherein the one or more bristles may be attached to a bottom surface of the intermediate wall.

Implementations of the disclosure may include further optional features as set forth herein. In some examples, the multi-functional hand-held apparatus comprises a first set of the one or more bristles being positioned in a second directional orientation. The first directional orientation may be different from the second directional orientation or the same. The first directional orientation may be an orientation towards an end of a front of the intermediate wall and the second directional orientation may be an orientation towards an end of a back of the intermediate wall.

In some examples, a lip may extend from a direction of a first side of the intermediate wall laterally across in a direction towards a second side of the intermediate wall. The lip may extend substantially perpendicular or laterally to a longitudinal direction of the intermediate wall, wherein the longitudinal direction of the intermediate wall may extend from the end of the back of the apparatus in a direction towards the front of the intermediate wall.

With reference to FIGS. 1-6, a multi-functional hand-held apparatus 10 for rinsing a surface with an element is provided and includes a housing 20, a resealable aperture 30, an intermediate wall 40, a lip 41 and a brush 50. The brush 50 comprising one or more bristles 51. The apparatus 10 may be divided into one or more regions. The regions may include a front region 12, a back region 11, and a middle region 17. The apparatus 10 may additionally include one or more side portions. The side portions may include a first side portion 14 and a second side portion 15, a bottom side portion 13, and a top side portion 16. The first side portion 14 and the second side portions 15 being opposing to one another. The housing 20, the resealable aperture 30, and the intermediate wall 40 include interior surfaces that define a chamber or an interior void 21 (the terms "chamber" and "interior void" may be used interchangeably throughout the disclosure).

The lip 41 may be attached or connected to the intermediate wall 40 and extends from a direction of the first side portion 14 continuously or discontinuously toward the opposing side portion 15. The lip 41 may extend from an end of the first side portion 14 of the intermediate 40 to and end of the second side portion 15 of the intermediate 40. The apparatus 10 includes one or more internal walls 22. The one or more internal walls 22 may be attached or connected to the intermediate wall 40 and the housing 20. The resealable aperture 30 may be disposed in the bottom side portion 13. In an exemplary implementation where the resealable aperture 30 may be disposed in or on the bottom side portion 13, the resealable aperture 30 may be attached or connected to the first side portion 14, the second side portions 15, the housing 20, the intermediate wall 40, the brush 50, the one or more bristles 51, or a combination thereof. The one or more resealable apertures 30 may be attached or connected to the back region 11, the front region 12, the middle region 17, the first side region 14, the second side region 15, the bottom side portion 13, the top side portion 16, or a combination thereof.

In an exemplary embodiment, the one or more resealable apertures 30 may comprise a one-way flow opening system 32 including a one-way valve system, a one-way flap system 31, or any other one-way liquid flow system. The one or more resealable apertures 30 may comprise a receptor, wherein the hose receptor being capable of attaching or connecting to a hose or to a hose attachment component. The hose receptor may work in conjunction with the one-way flow opening system 32 of the one or more resealable apertures 30, wherein at least a first resealable aperture of the one or more resealable apertures 30 comprising a one-way flow opening system 32, a hose receptor, or both. In one example, at least a first resealable aperture of the one or more resealable apertures 30 comprises the one-way flow opening system 32 and the hose receptor, and a second resealable aperture of the one or more apertures 30 comprises a hose receptor. The second resealable aperture may additionally comprise an aperture lid, or an external or integrated shut-off mechanism, for preventing a liquid from entering the interior void 21 when a hose may not be attached to the hose receptor. The external or integrated shut-off mechanism may comprise a twist-to-close mechanism, where twisting a component of the external or integrated shut-off mechanism by a predetermined degree, for example between 25 to 360, places the one or more resealable apertures 30 into an open position from a closed position, or vice versa. At least one of the one or more resealable apertures 30 or only the one-way flow opening system 32 may be removable or placed in an open position for allowing air to enter the interior void 21 at a higher rate, which may prevent a growth of bacteria, mold or other harmful organisms.

In one exemplary implementation, the one or more resealable apertures 30 may comprise a first body-component, wherein the first body component moving in conjunction or independent of the housing 20. The first body-component may comprise mechanical components including one or more springs or components that comprise spring-like properties. Engaging the first body-component may move the one or more resealable apertures 30 into an open position from a closed position for allowing an element or fluid to enter the chamber 21. In another exemplary implementation, engaging the first body-component may move the one or more resealable apertures 30 into the closed position from the open position for allowing an element or liquid (the terms "liquid" and "fluid" may be used interchangeably throughout the disclosure) to enter the chamber 21. Engaging the first body-component, one or more of the one or more walls, or both, creates a predetermined pressure by the element or fluid within the interior void or chamber 21. The predetermined pressure moves the one or more resealable apertures into a first closed position, maintaining the one or more resealable apertures in a closed position, or a combination thereof.

The housing 20 may at least partially be formed by materials that are soft or squishable and can be compressed and possess properties that allow the housing 20 to regain a pre-compressed shape in a relatively short period of time, for example less or equal to 5 seconds. An apparatus 10 may comprise materials that at least partially contain polymers. The intermediate wall 40, the brush 50, and/or the one or more bristles 51 may at least partially be formed by materials that are hard or less deformable as compared to the housing 20, as to reduce a probability of deforming the shape of the brush 50 or the intermediate wall 40 when engaging the housing 20 for dispensing the element or liquid through one or more pores 42.

In yet one exemplary implementation, the housing 20 may be comprised of fluid absorbing materials, for example but not limited to a sponge or a foam-based solid material (not illustrated). In this particular implementation, the sponge or the foam based solid material may or may not include a resealable aperture 30 due to their ability to absorb an element or fluid substantially through a large part of an outer surface of the sponge or the foam based solid material. An upper surface 60 of the intermediate wall 40 facing a top side portion 16 may extend in a direction toward the top side portion 16 and encompass a bottom side and at least partially a set of side portions of the housing 20 which may comprise the sponge or the foam-based solid material. The set of side portions may include a first side portion 14, a second side portion 15, a side portion of a back region 11, a side portion of a front region 12, or a combination thereof. The upper surface 60 extending onto the set of side portions of the housing 20 creates a barrier under the sponge or the foam-based solid material and prevents or reduces an amount of the element or fluid to escape or drip from the sponge or the foam based solid material unto a set of side portions of the intermediate wall 40, away from a brush surface 44 or away from one or more bristles 51.

In various implementations of the disclosed subject matter, a flexibility characteristic and a positioning of the one or more bristles 51 may be adjusted or be adjustable to accommodate various hair textures and lengths.

In some embodiments of the present disclosure of the subject matter, an exemplary multi-functional hand-held apparatus 10 may be composed of a thermoplastic rubber, a thermoplastic elastomer, or both in a manner that an exemplary multi-functional hand-held apparatus is provided to have a Shore A hardness in the range of 35 to 95, and preferably in the range of 35 to 74 in some areas, regions or portions and preferably in the range of 75 to 95 in some other areas, regions or portions. In some other embodiments, an exemplary multi-functional hand-held apparatus 10 is provided that is comprised of a thermoplastic rubber or thermoplastic elastomer such that the multi-functional hand-held apparatus 10 has a Shore A hardness of about 80 in some areas, regions or portions and a Shore A hardness of about 40 in some other areas, regions or portions.

As shown in FIG. 1, the lip 41 may be disposed in the back region 11 and extend lower than or below the one or more bristles 51 in the back region 11. The resealable aperture 30 may be connected to the housing 20 or the intermediate wall 40, and may be integrated, screwed on, clicked on, snapped on or any other way. The brush 50 may be integrated with the intermediate wall 40, the housing 20, or both. The brush 50 including the one or more bristles 51 may also be screwed on, clicked on, snapped on or any other way.

Figure 2:
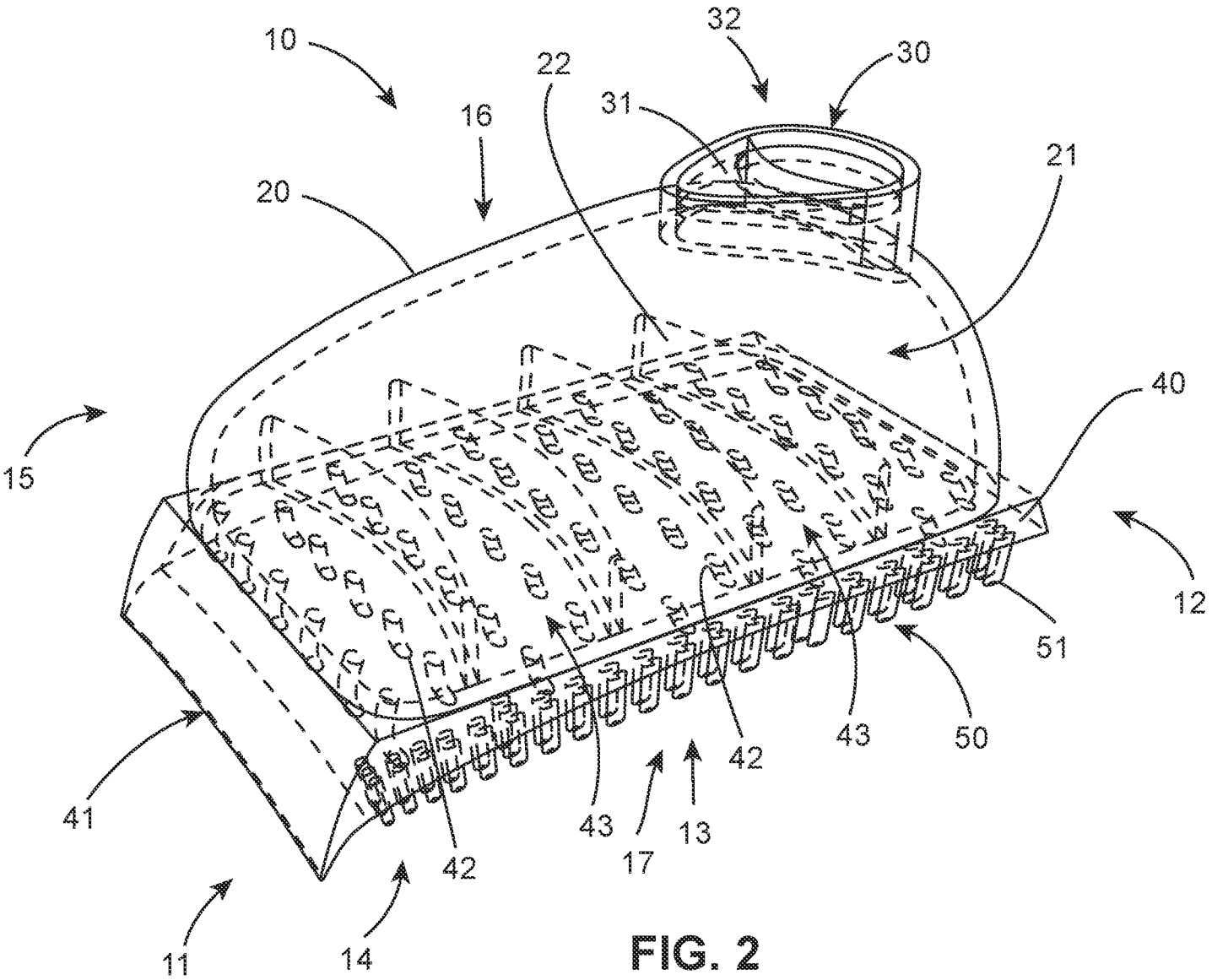
FIG. 2 is a see-through view of an exemplary apparatus similar to FIG. 1, and further illustrating a plurality of internal walls of the apparatus.

With continued reference to FIG. 2, a see-through view of the apparatus 10 is provided, wherein at least some internal parts, components, edges or curvatures that would otherwise not be visible from the illustrated point of view are illustrated by dashed lines. The one or more internal walls 22 extend from the first side portion 14 to the second side portion 15, and may comprise one or more additional internal walls (not illustrated) extending from the back region 11 to the front region 12, the internal walls 22 being attached to the first side portion 14 of the housing 20, the second side portion 15 of the housing 20 and the intermediate wall 40. The internal walls 22 may extend from the intermediate wall 40 in a direction towards a top side portion 16 of the housing 20 for a predetermined distance. The one or more walls 40 may extend in different distance values or may extend in the same distance value. The walls 40 may create a plurality of sub-chambers 43 between two or more internal walls 22 or an internal wall 22 and the housing 20.

The sub-chambers 43 allow for an increased amount of the element or fluid to remain or be kept within at least one or more of the sub-chambers 43 when the apparatus 10 is tilted or the intermediate wall is not leveled substantially perpendicular to a ground surface. The internal walls 22 may be curved and include a predetermined wall curvature when extending between the first side portion 14 and the second side portion 15. The predetermined wall curvature may include a radius of substantially constant curvature from the first side portion 14 of the housing 20 to the second side portion 15 of the housing 20. The predetermined wall curvature creates one or more segments within the one or more internal walls 22 that may be closer to an end of the front region 12 of the apparatus 10, farther away from the end of the front region 12 of the apparatus 10, or a combination thereof. The predetermined wall curvature of the one or more internal walls 22 enables the housing 20 to be compressed or squished with a lesser force as compared to the internal walls 22 extending substantially in a straight line between the opposing first and second side portions 14 and 15.

Figure 3:
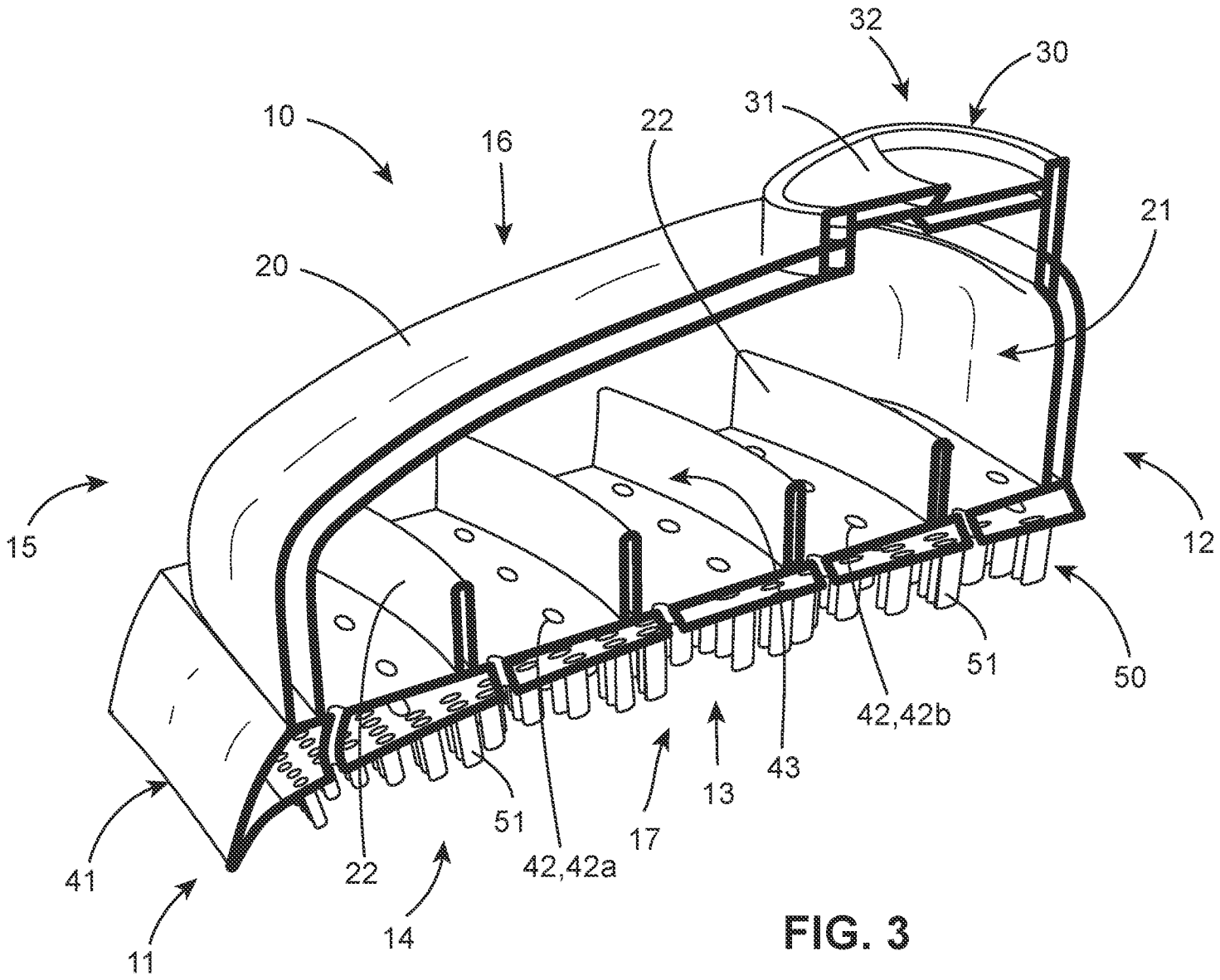
FIG. 3 is a cross-sectional perspective view of the apparatus of FIG. 1 taken along Line 1-1 of FIG. 1.

With continued reference to FIG. 3, the one or more pores 42 may be disposed within the one or more sub-chambers 43 for maintaining a supply of the element or liquid over a first set of the one or more pores 42*a* that may be located at a higher elevation than a second set of the one or more pores 42*b* for a longer period of time, as compared to an omission of the one or more internal walls 22 being proximate to the first set of the one or more pores 42*a*. Each of the one or more sub-chambers 43 may include a same number of pores 43 or may include different number of pores 43. The one or more resealable apertures 30 may be disposed on a top side portion 16, on a bottom side portion 13 or any other side portion. In an exemplary implementation of the embodiment, the one or more resealable apertures 30 may be disposed on a front side portion of the front region 12 or on a back side portion of the back region 11 (not illustrated).

Figure 4:
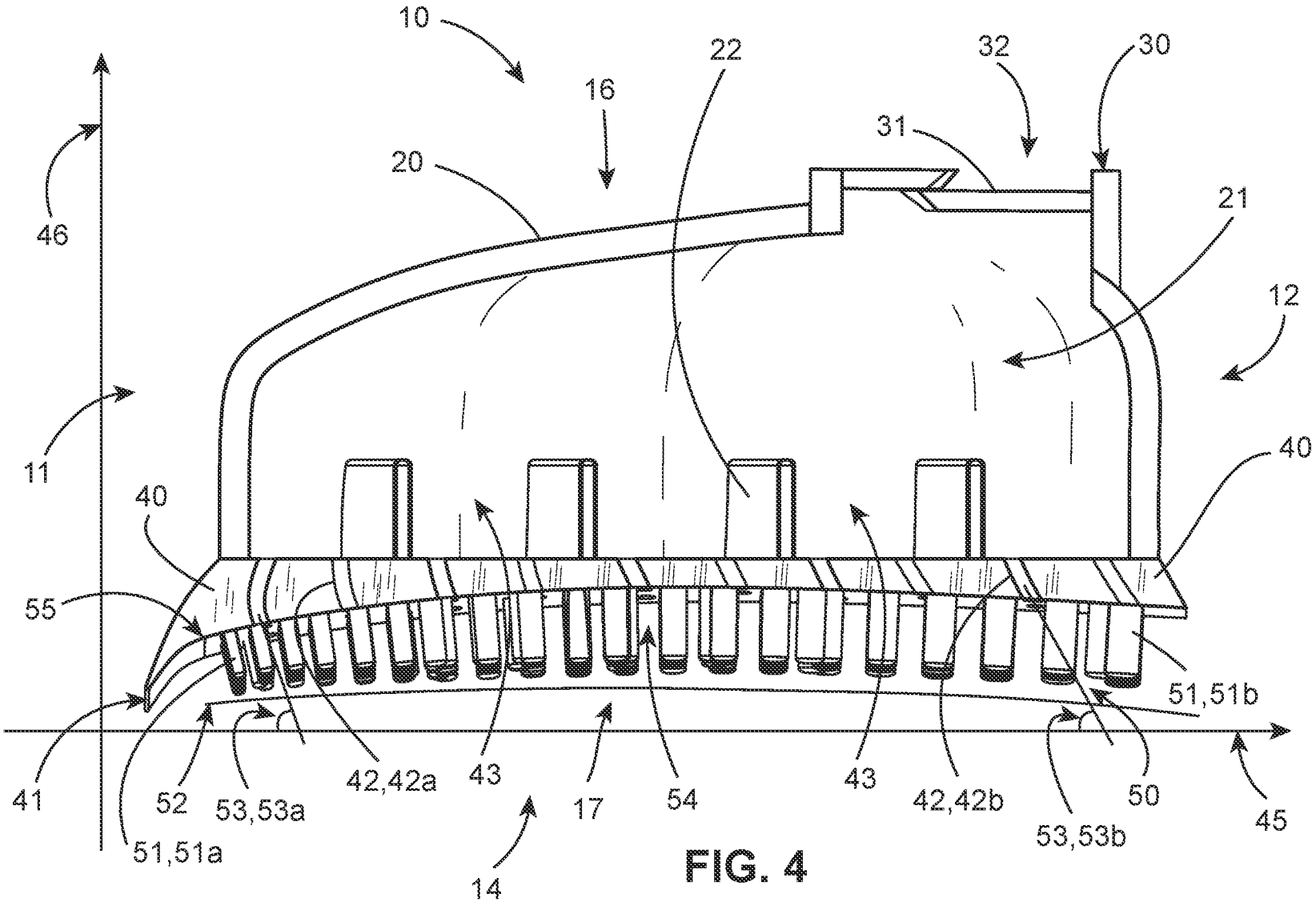
FIG. 4 is a cross-sectional side view of the apparatus of FIG. 1 taken along Line 1-1 of FIG. 1.

With particular reference to FIG. 4, a cross-sectional side view of the apparatus of FIG. 1 taken along Line 1-1 of FIG. 1 is provided. The one or more pores 42 may be disposed at an angle of direction relative to an x-axis 45, a y-axis 46, or both, wherein the x-axis 45 and the y-axis 46 are substantially perpendicular to one another. The one or more pores 42 may or may not be substantially parallel to the y-axis 46 or substantially perpendicular to the x-axis 45. The one or more pores 42 may be angled at a first angle of direction in a manner enabling an element or fluid to be dispersed or exerted from within the chamber 21 outward and partially unto the one or more bristles 51 at the angle of direction and in a direction toward an end of a front region 12 of the intermediate wall 40.

The angle of direction of the one or more pores 42 may be measured at an angle measurement point 53 where a measurement line, for measurement purposes, may be created by continuing a direction of the one or more pores 42 beyond or below a brush surface 44 and crossing the x-axis 45. The brush surface 44 may be a bottom surface of the intermediate wall 40 facing the one or more bristles 51. In an exemplary implementation of the embodiment, the one or more pores 42 may extend beyond or below the brush surface 44 and closer to an end of a bottom of the one or more bristles 51 (not illustrated). The one or more bristles 51 may attach or connect to the intermediate wall 40 at an end of a top of the one or more bristles 51 at or proximate to the brush surface 44.

The first angle of direction of a first set of one or more pores 42 may be a similar, same or different angle of direction than a second angle of direction, wherein the second angle of direction may be an angle of direction of a second set of one or more pores 42, wherein the first set of one or more pores 42 may be different from the second set of one or more pores 42. In an exemplary embodiment, a first set of one or more pores 42 may be disposed in the back region 11 and a second set of one or more pores 42 may be disposed in the front region 12. The first set of one or more pores 42 may include a first angle of direction being sharper or include a smaller value at a first angle of measurement point 53*a*, for example between 25-65 degrees, and the second set of one or more pores 42 may include a second angle of direction being less slanted or include a larger value at a second angle of measurement point 53*b*, for example between 60-80 degrees, or vice versa. The first angle of direction, the second angle of direction, or an angle of direction of the one or more bristles 51 enable the element or fluid to be dispersed, discharged or released from the chamber 21, including the one or more sub-chambers 43, from a point of release adjacent, connected, or proximate to the brush surface 44, through the one or more pores 42 in a direction toward the end of the front of the intermediate 44 or toward a back of a child's head and away from the child's face. The one or more pores 42 may include generally a directional orientation that may be facing the back region 12 of the intermediate 40.

In another embodiment, a first set of the one or more sub-chambers 43 may be closed off from a remaining number of the one or more sub-chambers 43. The first set of the one or more sub-chambers 43 may include a separate opening or separate resealable aperture to receive a different element or fluid as compared to an element of fluid being received by the remaining number of the one or more sub-chambers 43. The first set of the one or more sub-chambers 43 may include a separate set of one or more pores 42 for releasing or disbursing the different element or fluid.

The brush surface 44 may comprise a first convex portion 54 extending from the front region 12 of the intermediate 40 in a direction toward the back region 11 of the intermediate wall 40. The first convex portion 54 includes a first radius of substantially constant curvature from an end of the front region 12 of the brush surface 44 to a lip-brush surface point 55 within the back region 11 of the brush surface 44, where the lip 41 meets or transitions to the brush surface 44. The lip 41 and the brush surface 44 may comprise a similar or same composition of materials or a different composition of materials. A bottom surface of the lip 41 may include a similar or same radius of substantially constant curvature or a different radius of substantially constant curvature as compared to the first radius of substantially constant curvature of the brush surface 44.

A second line 52 may be drawn for measurement purposes along a collective bottom surface, or along a set of tips, of the one or more bristles 51. The second line 52 may include a similar or same radius of substantially constant curvature as the first radius of substantially constant curvature or a different radius of substantially constant curvature. The second line 52 may include a second convex portion with a second radius of substantially constant curvature from a tip of a foremost bristle 51*b* in the front region 12 to a tip of a hindmost bristle 51*a* in the back region 11. In an exemplary implementation, the first radius of substantially constant curvature may be similar or equal to the second radius of substantially constant curvature. In another exemplary implementation, the first radius of substantially constant curvature and the second radius of substantially constant curvature may converge within or beyond the back region 11, and/or they may diverge within or beyond the front region 12.

The brush 50 including the one or more bristles 51 may include the first and/or second radius of substantially constant curvature as to better conform with a shape of a child's head, in order for a larger number of the one or more bristles 51 to be capable of coming in contact with a child's scalp or head and/or for the one or more pores 42 to be disposed closer to the child's scalp, as compared to the brush surface 44 or the second line 52 being substantially flat. The second line 52 may represent a general shape or form of the one or more bristles along at least a two-dimensional longitudinal axis, wherein the two-dimensional longitudinal axis may comprise the x-axis 45 and the y-axis 46. The one or more pores 42 may have a first directional orientation, which may be related to a first angle of direction.

The lip 41 of the intermediate wall 40 may extend from a direction of the housing in a direction toward, beyond or below the tip of the hindmost bristle 53*a* and/or a set of hindmost one or more bristles laterally proximate to the hindmost bristle 53*a* that may be along a third axis, for example a z-axis 47 (see FIG. 5). The lip 41 may enable the apparatus 10 to collect a fractional amount of a total amount of run-off element or fluid that may have escaped from the chamber 21 or the one or more pores 42 in a direction toward an end of the front of the intermediate wall 40 and/or in a direction toward a face of a child. The lip 41 may mitigate an amount of element or fluid that may have otherwise reached the face of the child and/or eyes of the child, and thereby the lip 41 could potentially reduce an amount of discomfort for the child while rinsing hair of the child.

In yet another exemplary embodiment, a first set of one or more bristles 51 may be attached to at least partially a middle region 17 and the front region 12 of the brush surface 44 and a second set of one or more bristles 51 may be attached to at least partially the middle region 17 and the back region 11 of the brush surface 44. The first set of one or more bristles 51 may include a second directional orientation, which may be related to a second angle of direction, and the second set of one or more bristles 51 may include a first directional orientation, which may be related to the first angle of direction or a third angle of direction. The first directional orientation may be opposite to the second directional orientation and causing the one or more bristles 51 to form a convex portion with a radius of substantially constant curvature from a tip of a foremost bristle 51*b* in the front region 12 along a set of tips of the one or more bristles 51 in a middle region 17 and to a tip of a hindmost bristle 51*a* in the back region 11. The first directional orientation may be a direction toward the end of the front region 12 of the intermediate wall 40, and the second directional orientation may be a direction toward the end of the back region 11 of the intermediate wall 40, or vice versa.

The second set of the one or more bristles 51, including one or more bristles along a lateral column of the hindmost bristle 51*a*, may be smaller in a cross-lateral area size, larger in a cross-lateral area size, shorter, longer, more densely packed, less densely packed, or a combination thereof, as compared to the first set of the one or more bristles 51, including one or more bristles along a lateral column of the foremost bristle 51*b*. In an exemplary implementation of the embodiment, the second set of the one or more bristles 51 may be smaller in a cross-lateral area, shorter and/or more densely packed as compared to the first set of the one or more bristles 51, or vice versa. In an exemplary implementation, the second set of the one or more bristles 51 may be smaller in a cross-lateral area size, shorter, more densely packed, or a combination thereof, as compared to the first set of the one or more bristles 51, enabling the apparatus 10 including the second set of one or more bristles 51 to trap the element or fluid and push it in a same direction of a movement of the apparatus 10. The one or more bristles 51 may include different shapes, such as conically shaped. For example, the second set of the one or more bristles 51 may be circularly or cylindrically shaped and the first set of the one or more bristles 51 may be shaped elliptically or in a form of an oval.

Figure 5:
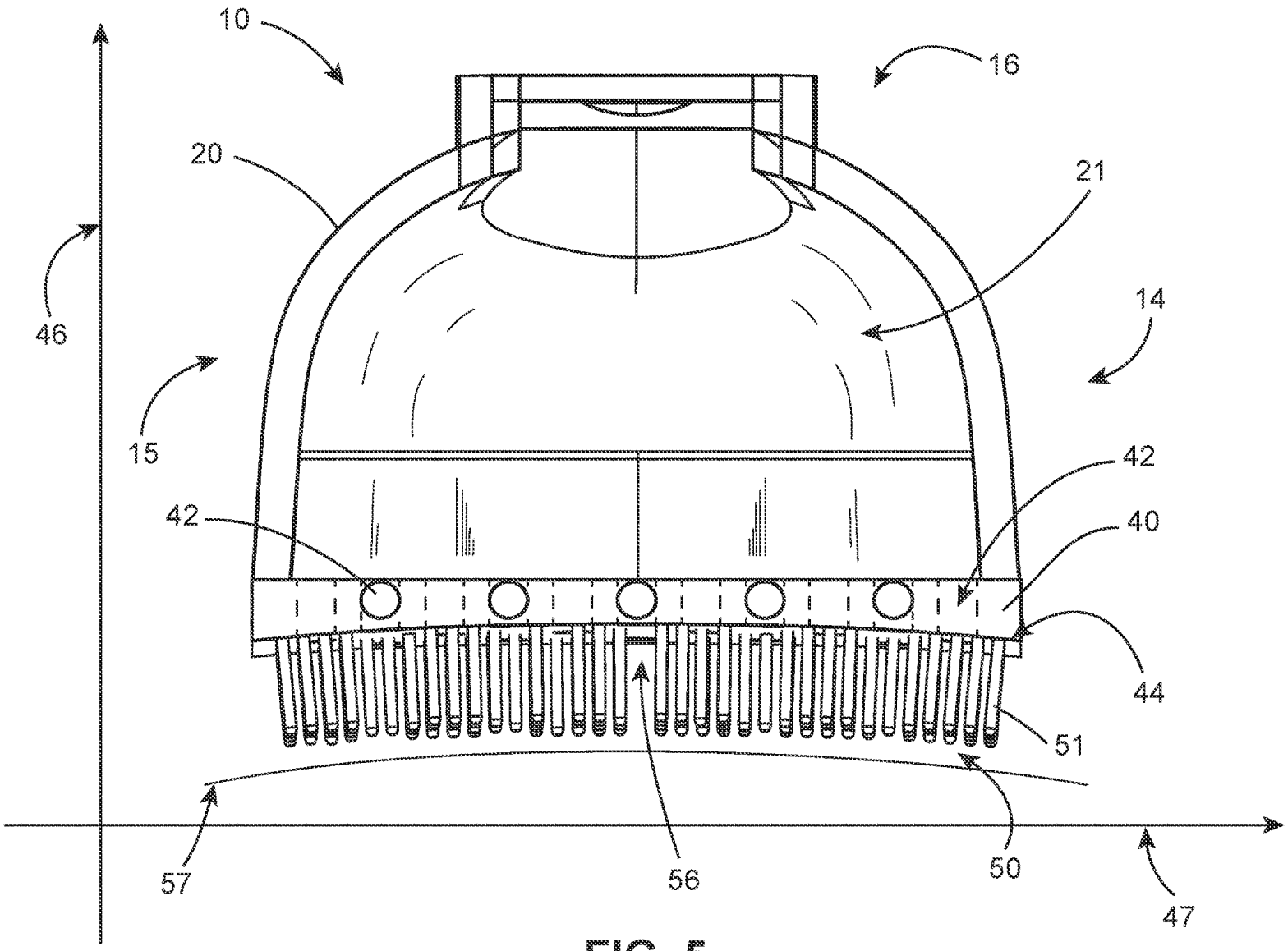
FIG. 5 is a cross-sectional side view of the apparatus of FIG. 1 taken along Line 2-2 of FIG. 1.

With particular reference to FIG. 5, the brush surface 44 may comprise a third convex portion 56 extending from an end of the first side portion 14 of the intermediate wall 40 to an end of the second side portion 15 of the intermediate wall 40. The third convex portion 56 includes a third radius of substantially constant curvature from an end of the first side portion 14 of the brush surface 44 to an end of the second side portion 15 of the brush surface 44.

A third line 57 may be drawn for measurement purposes along a collective bottom surface, or along a set of tips, of the one or more bristles 51 of the brush 50. The third line 57 may include a similar or same radius of substantially constant curvature as the third radius of substantially constant curvature or a different radius of substantially constant curvature. The third line 57 may include a fourth convex portion with a fourth radius of substantially constant curvature from a tip of a starting bristle 51*c* in the first side portion 14 to a tip of an ending bristle 51*d* in the second side portion 15. In an exemplary implementation, the third radius of substantially constant curvature may be similar or equal to the fourth radius of substantially constant curvature, or they might be different. In another exemplary implementation, the third radius of substantially constant curvature and the fourth radius of substantially constant curvature may converge within or beyond the first side portion 14 or the second side portion 15, and/or they may diverge within or beyond the first side portion 14 or the second side portion 15.

The brush 50 including the one or more bristles 51 may include the third and/or fourth radius of substantially constant curvature as to better conform with the shape of the child's head, in order for a larger number of the one or more bristles 51 to be capable of coming in contact with the child's scalp or head and/or for the one or more pores 42 to be disposed closer to the child's scalp or head, as compared to the brush surface 44 or the third line 57 being substantially flat. The third line 57 may represent a general shape or form of the one or more bristles along a two-dimensional lateral axis, wherein the two-dimensional lateral axis may be the z-axis 47 or similar to.

Figure 6:
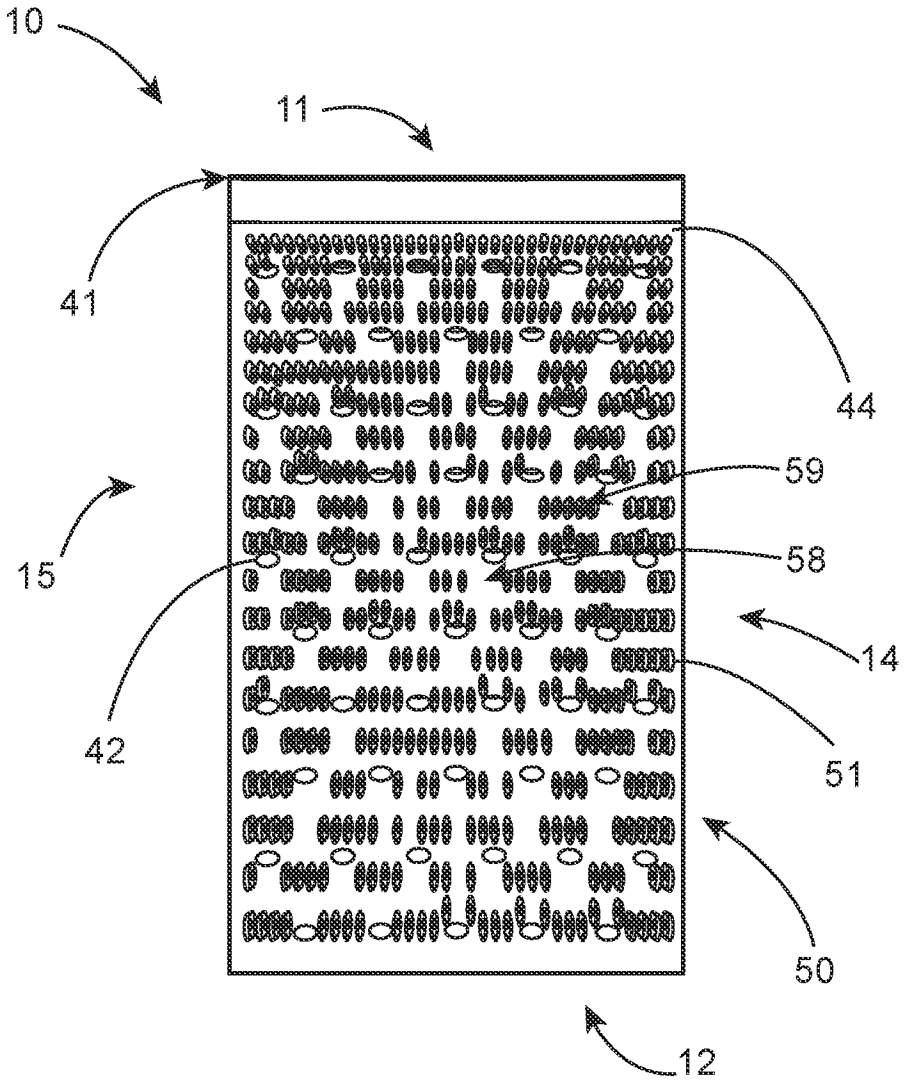
FIG. 6 is a bottom view of the apparatus of FIG. 1, and further illustrating one or more bristles surrounding one or more pores.

As shown in FIG. 6, the brush surface 44 may include at least the one or more pores 42, one or more lips including the lip 41, one or more bristles 51, or a combination thereof. The brush surface 44 may be divided into multiple bristle regions, wherein a first set of bristle regions 58 may include a smaller number of bristles disposed therein and a second set of bristle regions 59 with a larger number of bristles disposed therein. The first set of bristle regions 58 may be disposed proximate to the one or more pores 42 in a direction toward the end of the front region 12 of the brush surface 44, in order for a region proximate to the one or more pores 42 in a location being closer to the end of the front region 12 of the brush surface 44 as compared to a location of the one or more pores 42.

In an exemplary embodiment, a first set of the one or more bristles 51 may be disposed in an area proximate to a set of the one or more pores 42, wherein the first set of the one or more bristles 51 may be disposed in front of the set of the one or more pores 42. The first set of the one or more bristles 51 may be disposed between the set of the one or more pores 42 in a direction toward the end of the front region 12 of the brush surface 44. The first set of the one or more bristles 51 may comprise an amount of the one or more bristles 51 that is larger as compared to an amount of one or more bristles 51 of a second set of the one or more bristles 51. The first set of the one or more bristles 51 and the second set of the one or more bristles 51 may not be overlapping. The second set of the one or more bristles 51 may be disposed laterally from the set of the one or more pores 42 along a lateral direction from the first side portion 14 of the intermediate 40 to the second side portion 15 of the intermediate wall 40. The second set of the one or more bristles 51 may also be disposed laterally at least between the set of the one or more pores 42 along a lateral direction from the first side portion 14 of the intermediate 40 to the second side portion 15 of the intermediate wall 40. The second set of the one or more bristles 51 may also be disposed along a longitudinal direction from the end of the back region 11 of the brush surface 40 to the end of the front region 12 of the brush surface 40, but not immediately in front of the set of the one or more pores 42. The front of the set of the one or more pores 42 may be defined as an area between one of the set of the one or more pores 42 and another one of the set of the one or more pores 42 or the end of the front region 12 of the brush surface 40.

The first set of the one or more bristles 51 may comprise a number of one or more bristles 51 that may be less or smaller, as compared to the second set of the one or more bristles 51. The first set of one or more bristles 51 may be related to the first set of bristle region 58 and the second set of the one or more bristles 51 may be to the second set of bristle regions 59. The first set of bristle regions 58 may provide an area of one or more bristles 51 that may be less densely populated by the one or more bristles, as compared to the second set of bristle regions 59, for enabling an easier, more efficient and/or more effective disbursement, dispensing, or releasing of the element or fluid out of the chamber 21 and unto a preferred surface, such as a child's scalp, without the element or fluid being partially blocked by a set of the one or more bristles 51.

In an exemplary implementation of the embodiment, the first set of bristle regions 58 may not include a bristle in a conical shape or a triangular shape immediately in front of the one or more pores 42 where the element or fluid may be released onto with a directional orientation or an angle of direction. In another exemplary implementation of the embodiment, the one or more bristles of the first set of bristle regions 58 and the second set of bristle regions 59 may be disposed onto the brush surface 44 in a manner as to guide the element or fluid as it is being released out of the chamber 21. In another exemplary embodiment, the one or more bristles include a higher density, i.e. having a larger number of bristles, within the back region 11 as compared to a number of bristles disposed in the front region 12.

The following Clauses provide configurations for a multi-functional hand-held apparatus described above.

Clause 1: A multi-functional hand-held apparatus for rinsing a surface with an element, comprising a housing, wherein the housing holding the element within at least one or more walls; the one or more walls comprising at least a first side wall, a second side wall, and an intermediate wall, one or more resealable apertures, the intermediate wall of the one or more walls of the housing comprising one or more pores, wherein the one or more pores enable the element to traverse through the intermediate wall, a first set of the one or more pores having a first directional orientation, the one or more pores exerting the element when engaging a first body-component or one or more of the one or more walls, wherein the first body-component attaching to the housing and moving in conjunction or independent of the housing, the one or more resealable apertures may be attached to one or more of the one or more walls or in between one or more of the one or more walls, the housing comprising a chamber, wherein the chamber is created at least by the one or more walls, including the intermediate wall, and the one or more resealable apertures, engaging the first body-component or one or more of the one or more walls creating a predetermined pressure by the element within the chamber, the predetermined pressure moving the one or more resealable apertures into a first closed position or maintaining the one or more resealable apertures in the first closed position, the predetermined pressure on the chamber changing a volume of the chamber and creating a reduction in the volume of the chamber, creating the predetermined pressure on the chamber and the reduction in the volume of the chamber exerting the element through at least one or more of the one or more pores, one or more bristles, wherein the one or more bristles attaching to a bottom surface of the intermediate wall, a first set of the one or more bristles being positioned in a second directional orientation, the first directional orientation being different from the second directional orientation.

Clause 2: The multi-functional hand-held apparatus of Clause 1, further comprising the first directional orientation being an orientation towards an end of a front of the intermediate wall, and the second directional orientation being an orientation towards an end of a back of the intermediate wall.

Clause 3: The multi-functional hand-held apparatus of Clause 2, wherein the back of the intermediate wall further comprising a lip, wherein the lip extending from a direction of a first side of the intermediate wall laterally across in a direction towards a second side of the intermediate wall, and the lip extending substantially perpendicular or laterally to a longitudinal direction of the intermediate wall, wherein the longitudinal direction of the intermediate wall extending from the end of the back of the apparatus in a direction towards the front of the intermediate wall.

Clause 4: The multi-functional hand-held apparatus of Clause 1, further comprising the first directional orientation being diagonally directional, one-directional, multi-directional or a combination of two or more of diagonally directional, one-directional and multi-directional, and the second directional orientation being diagonally directional, one-directional, multi-directional or a combination of two or more of diagonally directional, one-directional and multi-directional.

Clause 5: The multi-functional hand-held apparatus of Clause 1, further comprising a second set of the one or more bristles being positioned in a first directional orientation, the first set of the one or more bristles and the second set of the one or more bristles being substantially aligned according to a first curvature in a first directional orientation and a third curvature in a third directional orientation, wherein the one or more bristles creating a convex shape from a view of the housing.

Clause 6: The multi-functional hand-held apparatus of Clause 1, further comprising the first set of the one or more bristles being angled at a first predetermined angle, a second set of the one or more bristles being angled at a second predetermined angle, and the first predetermined angle and the second predetermined angle being different.

Clause 7: The multi-functional hand-held apparatus of Clause 1, further comprising the first set of the one or more bristles being spaced apart from each other at a first predetermined distance, a second set of the one or more bristles, wherein the second set of the at least one or more bristles being spaced apart from each other at a second predetermined distance, the first set of the one or more bristles and the second set of the one or more bristles being different, wherein the first set of the one or more bristles comprising one or more bristles of the second set of the one or more bristles and the second set of the one or more bristles comprising one or more bristles of the first set of the one or more bristles, the first predetermined distance and the second predetermined distance being different or the same.

Clause 8: The multi-functional hand-held apparatus of Clause 1, further comprising each of the one or more bristles comprising a tip and forming at least a brush-surface along the tips, wherein the brush-surface being located proximate to the one or more pores, the one or more bristles being co-located with the pores, wherein the pores being distributed among the one or more bristles for disbursing the element along the one or more bristles; a brush-base, wherein the brush-base being formed by or being attached to the bottom surface of the intermediate wall and the one or more bristles terminating at and connected to the brush-base, a first area of the brush-base being proximate to a first set of the one or more pores and being located in a direction toward the end of the front of the intermediate wall relative to the first set of the one or more pores and excluding at least one or more of the one or more bristles and creating a first bristle-occupied area in front of the first set of the one or more pores, a second area of the brush-base being proximate to the first set of the one or more pores and being located in a direction toward the end of the back of the intermediate wall relative to the first set of the one or more pores and including at least one or more of the one or more bristles and creating a second bristle-occupied area behind the first set of the one or more pores, and the first bristle-occupied area being less densely populated by the one or more bristles than the second bristle-occupied area.

Clause 9: The multi-functional hand-held apparatus of Clause 1, further comprising the first set of the one or more bristles are a first predetermined length, a second set of the one or more bristles, wherein the second set of the one or more bristles are a second predetermined length, the first predetermined length and the second predetermined length being different.

Clause 10: The multi-functional hand-held apparatus of Clause 1, further comprising the first set of the one or more bristles being distributed within a first bristle-occupied area at a first bristle density, a second set of the one or more bristles, wherein the second set of the one or more bristles being distributed within a second bristle-occupied area at a second bristle density, the first bristle density and the second bristle density being different, wherein the second bristle density may be a higher bristle density than the first bristle density.

Clause 11: The multi-functional hand-held apparatus of Clause 1, further comprising the first set of the one or more bristles being of a first cross-sectional area size, a second set of the one or more bristles, wherein the second set of the one or more bristles being of a second cross-sectional area size, the first cross-sectional area size and the second cross-sectional area size being different, wherein the second cross-sectional area size may be a smaller cross-sectional area size than the first cross-sectional area size.

Clause 12: The multi-functional hand-held apparatus of Clause 1, further comprising the one or more pores being internally located within the intermediate wall and may traverse through a second wall of the housing, wherein the second wall of the housing comprises at least a first brush-surface, a second brush-surface, or a combination of at least the first brush-surface and the second brush-surface.

Clause 13: The multi-functional hand-held apparatus of Clause 1, further comprising the at least one or more pores being at least partially external and extending out from a second wall of the housing, wherein the second wall of the housing comprises at least a first brush-surface, a second brush-surface, or both.

Clause 14: The multi-functional hand-held apparatus of Clause 1, further comprising the one or more bristles are angled at a first angle and the one or more pores are angled at a second angle, the first angle and the second angle are different.

Clause 15: The multi-functional hand-held apparatus of Clause 1, further comprising the bottom surface of the intermediate wall or a brush-base being curved or sloped.

Clause 16: The multi-functional hand-held apparatus of Clause 1, further comprising the intermediate wall or a brush-base being curved with a starting curvature and an ending curvature the starting curvature and the ending curvature being different or the same.

Clause 17: The multi-functional hand-held apparatus of Clause 1, further comprising the element being a fluid, water or water mixed with another element.

Clause 18: The multi-functional hand-held apparatus of Clause 1, wherein the one or more resealable apertures further comprising one or more one-directional flaps, wherein the one or more one-directional flaps moving to create an opening when the element is pushing against an outside wall of the one or more flaps and allowing the element to enter the chamber, wherein one or more of the one or more one-directional flaps may be removable, one or more one-directional caps, wherein the one or more one directional caps moving to create an opening when the element is pushing against an outside wall of the one or more one-directional caps and allowing the element to enter the chamber, wherein one or more of the one or more one-directional caps may be removable, one or more doors, wherein the door moving when engaging the first body-component or one or more of the one or more walls or one or more walls of the one or more resealable apertures, or a combination of the one or more one-directional flaps, the one or more one-directional caps and the one or more doors.

Clause 19: The multi-functional hand-held apparatus of Clause 1, wherein the one or more resealable apertures further comprising one or more doors, wherein the one or more doors moving by sliding, folding, wrapping or a combination thereof.

Clause 20: The multi-functional hand-held apparatus of Clause 1, further comprising a second body-component, the second body-component attaching to one or more of the one or more walls, and engaging the second body-component moving the second body-component independently from the one or more of the one or more walls.

Clause 21: The multi-functional hand-held apparatus of Clause 19, further comprising engaging the first body-component or the second body-component tightening a closure of the chamber or closing the chamber, except for one or more of the one or more pores.

Clause 22: The multi-functional hand-held apparatus of Clause 1, further comprising the at least one or more pores are shaped circular, oval, square, rectangular, wavy or a combination thereof, wherein a first set of the one or more pores are shaped differently from a second set of the one or more pores.

Clause 23: The multi-functional hand-held apparatus of Clause 1, further comprising the at least one or more bristles and the at least one or more pores attaching to a second intermediate wall, wherein the second intermediate wall comprising one or more lips, at least one or more of the one or more lips attaching to an end of the second wall and extending from a direction of a first side of the second intermediate wall toward a direction of a second side of the second intermediate wall, the at least one or more of the one or more lips comprising an edge, wherein the edge of the lip is curved away from an intermediate area of the at least one or more of the one or more lips in a direction being downward, upward, inward, outward, diagonally, straight, or a combination thereof.

Clause 24: The multi-functional hand-held apparatus of Clause 1, further comprising the at least one or more bristles are shaped at least at an end, the at least at the end of the at least one or more bristles are shaped circular, curved, squared, rectangular, triangle, multi-angular, straight, flat or a combination thereof.

Clause 25: The multi-functional hand-held apparatus of Clause 1, wherein the one or more resealable apertures further comprising a floating device, wherein the floating device automatically raises when a predetermined level of fluid or other elements entering the chamber and moving the one or more resealable apertures into a closed position, the one or more resealable apertures closing the chamber except for one or more of the one or more pores.

Clause 26: A method for rinsing a surface with an element comprising a housing, wherein the housing holding an element within at least one or more walls, one or more pores with a first directional orientation orienting toward a first spatial direction and away from a second spatial direction, the one or more pores embedding within an intermediate wall, wherein the intermediate wall being disposed between one or more bristles and a chamber, the one or more pores creating an opening within the chamber, wherein the element may enter or exit the chamber through the one or more pores, the one or more pores exerting the element when engaging a first body-component or the housing, the first body-component being attached to the housing or a second body-component, wherein the second body-component attaching to the housing and moving in conjunction or independent of the housing, one or more resealable apertures, wherein the one or more resealable apertures being attached to the first body-component, the second body-component, the housing, the intermediate wall or a combination thereof, the chamber being at least partially created by the housing and the one or more resealable apertures, engaging the first body-component or the housing moving the one or more resealable apertures into a closed position, engaging the first body-component or the housing creating a pressure on the chamber, wherein a volume of the chamber changing when engaging the first body-component and creating a reduction in the volume of the chamber, creating the pressure on the chamber and the reduction in the volume of the chamber exerting the element through the one or more pores, the one or more bristles positioning on a side of the chamber and proximate to the at least one or more pores, a first set of the one or more bristles positioned in a second directional orientation, and the first directional orientation is different from the second directional orientation.

What is claimed is:

1. A multi-functional hand-held apparatus for rinsing a surface with an element, comprising:

a housing, wherein the housing holding the element within at least one or more walls;

the one or more walls comprising at least a first side wall, a second side wall, and an intermediate wall;

one or more resealable apertures;

the intermediate wall of the one or more walls of the housing comprising one or more pores, wherein the one or more pores enabling the element to traverse through the intermediate wall;

a first set of the one or more pores having a first directional orientation;

the one or more pores exerting the element when engaging a first body-component or one or more of the one or more walls, wherein the first body-component attaching to the housing and moving in conjunction or independent of the housing;

the one or more resealable apertures attaching to one or more of the one or more walls, in between one or more of the one or more walls, the intermediate wall, or a combination thereof;

the housing comprising a chamber, wherein the chamber is created at least by the one or more walls, including the intermediate wall, and the one or more resealable apertures;

engaging the first body-component or one or more of the one or more walls creating a predetermined pressure by the element within the chamber;

the predetermined pressure moving the one or more resealable apertures into a first closed position or maintaining the one or more resealable apertures in the first closed position;

the predetermined pressure on the chamber changing a volume of the chamber and creating a reduction in the volume of the chamber;

creating the predetermined pressure on the chamber and the reduction in the volume of the chamber exerting the element through at least one or more of the one or more pores;

one or more bristles, wherein the one or more bristles attaching to a bottom surface of the intermediate wall; and a first set of the one or more bristles being positioned in a second directional orientation.

2. The multi-functional hand-held apparatus of claim 1, further comprising:

the first directional orientation may be different from the second directional orientation; or the first directional orientation being an orientation towards an end of a front of the intermediate wall, and the second directional orientation being an orientation towards an end of a back of the intermediate wall.

3. The multi-functional hand-held apparatus of claim 2, wherein the back of the intermediate wall further comprising:

a lip, wherein the lip extending from a direction of a first side of the intermediate wall laterally across in a direction towards a second side of the intermediate wall; and the lip extending substantially perpendicular or laterally to a longitudinal direction of the intermediate wall, wherein the longitudinal direction of the intermediate wall extending from the end of the back of the housing in a direction towards the front of the intermediate wall.

4. The multi-functional hand-held apparatus of claim 1, further comprising:

the first directional orientation being diagonally directional, one-directional, multi-directional or a combination of two or more of diagonally directional, one-directional and multi-directional; and the second directional orientation being diagonally directional, one-directional, multi-directional or a combination of two or more of diagonally directional, one-directional and multi-directional.

5. The multi-functional hand-held apparatus of claim 1, further comprising:

a second set of the one or more bristles being positioned in a first directional orientation;

the first set of the one or more bristles and the second set of the one or more bristles being substantially aligned according to a first curvature in a first directional orientation and a third curvature in a third directional orientation, wherein the one or more bristles creating a convex shape from a view of the housing.

6. The multi-functional hand-held apparatus of claim 1, further comprising:

the first set of the one or more bristles being angled at a first predetermined angle;

a second set of the one or more bristles being angled at a second predetermined angle; and the first predetermined angle and the second predetermined angle being different.

7. The multi-functional hand-held apparatus of claim 1, further comprising:

the first set of the one or more bristles being spaced apart from each other at a first predetermined distance;

a second set of the one or more bristles, wherein the second set of the at least one or more bristles being spaced apart from each other at a second predetermined distance;

the first set of the one or more bristles and the second set of the one or more bristles being different, wherein the first set of the one or more bristles comprising one or more bristles of the second set of the one or more bristles and the second set of the one or more bristles comprising one or more bristles of the first set of the one or more bristles;

the first predetermined distance and the second predetermined distance being different or the same.

8. The multi-functional hand-held apparatus of claim 1, further comprising:

each of the one or more bristles comprising a tip and forming at least a brush-surface along the tips, wherein the brush-surface being located proximate to the one or more pores;

the one or more bristles being co-located with the pores, wherein the pores being distributed among the one or more bristles for disbursing the element along the one or more bristles;

a brush-base, wherein the brush-base being formed by or being attached to the bottom surface of the intermediate wall and the one or more bristles terminating at and connected to the brush-base;

a first area of the brush-base being proximate to a first set of the one or more pores and being located in a direction toward the end of the front of the intermediate wall relative to the first set of the one or more pores and excluding at least one or more of the one or more bristles and creating a first bristle-occupied area in front of the first set of the one or more pores;

a second area of the brush-base being proximate to the first set of the one or more pores and being located in a direction toward the end of the back of the intermediate wall relative to the first set of the one or more pores and including at least one or more of the one or more bristles and creating a second bristle-occupied area behind the first set of the one or more pores; and the first bristle-occupied area being less densely populated by the one or more bristles than the second bristle-occupied area.

9. The multi-functional hand-held apparatus of claim 1, further comprising:

the first set of the one or more bristles are a first predetermined length;

a second set of the one or more bristles, wherein the second set of the one or more bristles are a second predetermined length;

the first predetermined length and the second predetermined length being different.

10. The multi-functional hand-held apparatus of claim 1, further comprising:

the first set of the one or more bristles being distributed within a first bristle-occupied area at a first bristle density;

a second set of the one or more bristles, wherein the second set of the one or more bristles being distributed within a second bristle-occupied area at a second bristle density;

the first bristle density and the second bristle density being different, wherein the second bristle density may be a higher bristle density than the first bristle density.

11. The multi-functional hand-held apparatus of claim 1, further comprising:

the first set of the one or more bristles being of a first cross-sectional area size;

a second set of the one or more bristles, wherein the second set of the one or more bristles being of a second cross-sectional area size;

the first cross-sectional area size and the second cross-sectional area size being different, wherein the second cross-sectional area size may be a smaller cross-sectional area size than the first cross-sectional area size.

12. The multi-functional hand-held apparatus of claim 1, further comprising:

the one or more pores being internally located within the intermediate wall and may traverse through a second wall of the housing, wherein the second wall of the housing comprises at least a first brush-surface, a second brush-surface, or a combination of at least the first brush-surface and the second brush-surface.

13. The multi-functional hand-held apparatus of claim 1, further comprising:

the at least one or more pores being at least partially external and extending out from a second wall of the housing, wherein the second wall of the housing comprises at least a first brush-surface, a second brush-surface, or both.

14. The multi-functional hand-held apparatus of claim 1, further comprising:

the one or more bristles are angled at a first angle and the one or more pores are angled at a second angle;

the first angle and the second angle are different.

15. The multi-functional hand-held apparatus of claim 1, further comprising:

the bottom surface of the intermediate wall or a brush-base being curved or sloped.

16. The multi-functional hand-held apparatus of claim 1, further comprising:

the intermediate wall or a brush-base being curved with a starting curvature and an ending curvature;

the starting curvature and the ending curvature being different or the same.

17. The multi-functional hand-held apparatus of claim 1, wherein the one or more resealable apertures further comprising:

one or more one-directional flaps, wherein the one or more one-directional flaps moving to create an opening when the element is pushing against an outside wall of the one or more flaps and allowing the element to enter the chamber, wherein one or more of the one or more one-directional flaps may be removable;

one or more one-directional caps, wherein the one or more one directional caps moving to create an opening when the element is pushing against an outside wall of the one or more one-directional caps and allowing the element to enter the chamber, wherein one or more of the one or more one-directional caps may be removable;

one or more doors, wherein the door moving when engaging the first body-component or one or more of the one or more walls or one or more walls of the one or more resealable apertures; or a combination of the one or more one-directional flaps, the one or more one-directional caps and the one or more doors.

18. The multi-functional hand-held apparatus of claim 1, further comprising:

a second body-component, the second body-component attaching to one or more of the one or more walls; and engaging the second body-component moving the second body-component independently from the one or more of the one or more walls.

19. The multi-functional hand-held apparatus of claim 1, further comprising:

the at least one or more bristles and the at least one or more pores attaching to a second intermediate wall, wherein the second intermediate wall comprising one or more lips;

at least one or more of the one or more lips attaching to an end of the second wall and extending from a direction of a first side of the second intermediate wall toward a direction of a second side of the second intermediate wall;

the at least one or more of the one or more lips comprising an edge, wherein the edge of the lip is curved away from an intermediate area of the at least one or more of the one or more lips in a direction being downward, upward, inward, outward, diagonally, straight, or a combination thereof.

20. A method for rinsing a surface with an element comprising:

a housing, wherein the housing holding the element within at least one or more walls;

the one or more walls comprising at least a first side wall, a second side wall, and an intermediate wall;

one or more resealable apertures;

the intermediate wall of the one or more walls of the housing comprising one or more pores, wherein the one or more pores enabling the element to traverse through the intermediate wall;

a first set of the one or more pores having a first directional orientation;

the one or more pores exerting the element when engaging a first body-component or one or more of the one or more walls, wherein the first body-component attaching to the housing and moving in conjunction or independent of the housing;

the one or more resealable apertures attaching to one or more of the one or more walls, in between one or more of the one or more walls, the intermediate wall, or a combination thereof;

the housing comprising a chamber, wherein the chamber is created at least by the one or more walls, including the intermediate wall, and the one or more resealable apertures;

engaging the first body-component or one or more of the one or more walls creating a predetermined pressure by the element within the chamber;

the predetermined pressure moving the one or more resealable apertures into a first closed position or maintaining the one or more resealable apertures in the first closed position;

the predetermined pressure on the chamber changing a volume of the chamber and creating a reduction in the volume of the chamber;

creating the predetermined pressure on the chamber and the reduction in the volume of the chamber exerting the element through at least one or more of the one or more pores;

one or more bristles, wherein the one or more bristles attaching to a bottom surface of the intermediate wall; and a first set of the one or more bristles being positioned in a second directional orientation.

* * * * *